United States Patent [19]

Deborde et al.

[11] Patent Number: 4,543,999

[45] Date of Patent: Oct. 1, 1985

[54] SEQUENTIAL CLEANING DEVICE FOR A LOOM

[75] Inventors: Albert H. Deborde; Gilles Grandvallet, both of Bourgoin Jallieu, France

[73] Assignee: Saurer Diederichs, Bourgoin Jallieu, France

[21] Appl. No.: 541,668

[22] Filed: Oct. 13, 1983

[30] Foreign Application Priority Data

Oct. 26, 1982 [FR] France ..... 82 18361

[51] Int. Cl.[4] ..... D03D 49/00; D03D 47/30

[52] U.S. Cl. ..... 139/1 C; 139/435; 15/300 R

[58] Field of Search ..... 139/1 C, 435; 15/300 R, 15/300 A, 301; 226/97; 66/168

[56] References Cited

U.S. PATENT DOCUMENTS

| | | | |
|---|---|---|---|
| 3,491,801 | 1/1970 | Lippuner | 139/1 C |
| 3,782,422 | 1/1974 | Vermeulen | 139/435 |
| 4,392,517 | 7/1983 | Takahashi | 139/435 |
| 4,397,339 | 8/1983 | Muller | 139/1 C |
| 4,410,016 | 10/1983 | Manders | 139/435 |

FOREIGN PATENT DOCUMENTS

| | | | |
|---|---|---|---|
| 357490 | 7/1980 | Austria . | |
| 436155 | 11/1967 | Switzerland . | |
| 584302 | 1/1977 | Switzerland | 139/1 C |

*Primary Examiner*—James Kee Chi

*Attorney, Agent, or Firm*—Karl F. Ross; Herbert Dubno

[57] ABSTRACT

A sequential cleaning device for a loom ensures sequential cleaning by blowing compressed air or possibly by suction, at various points of a loom. The device comprises, upstream of a utilization circuit leading to various points to be cleaned, a pneumatic control circuit connected to a compressed air inlet. The circuit comprises, in a main pneumatic line a first distributor which is normally closed, and controlled mechanically and a second distributor which is normally open and controlled pneumatically. Controlling the opening of the first distributor may be effected by a rotary member forming a cam of the loom. Controlling the closure of the second distributor is ensured by a branch supply line in which pneumatic delay means are incorporated.

5 Claims, 1 Drawing Figure

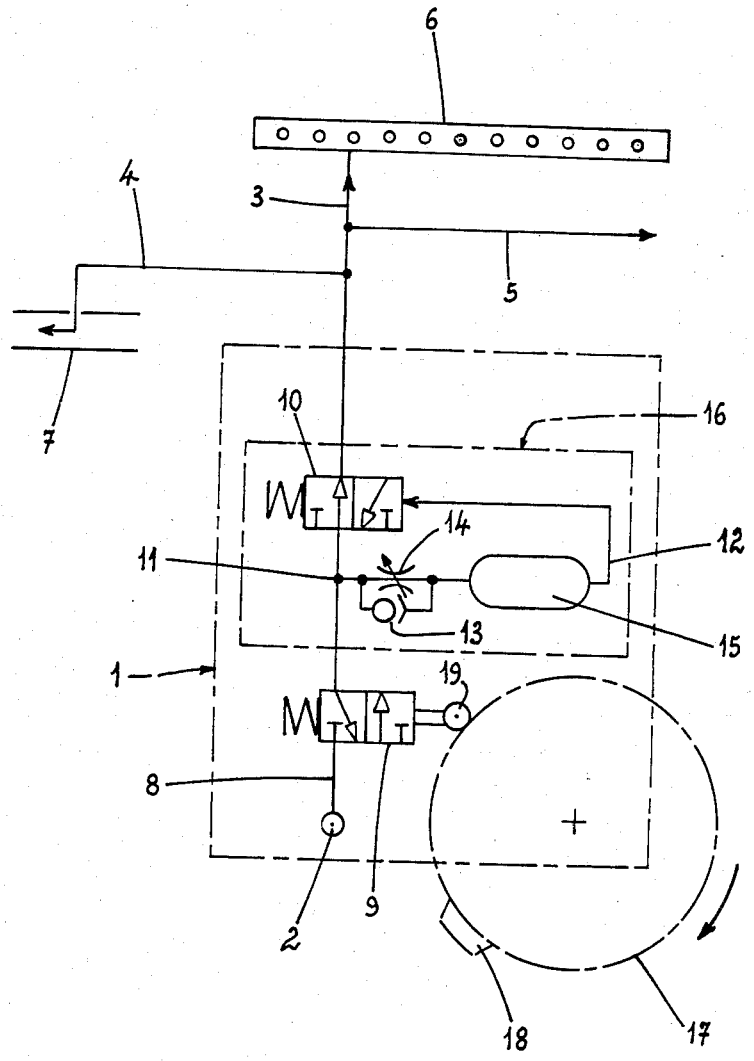
6
4
3
5
7
10
16
14
12
11
13
15
1
19
8
9
2
18
17

SEQUENTIAL CLEANING DEVICE FOR A LOOM

FIELD OF THE INVENTION

The present invention relates to a sequential cleaning device operating by blowing compressed air or possibly by suction, for a loom.

BACKGROUND OF THE INVENTION

In the weaving of fibrous yarn, fluff is produced by the unwinding. This fluff becomes detached and is deposited on the weft yarn, thus causing the following problems:

when the weft is inserted by mechanical means: the fluff which is not removed is the cause of defects in the woven material;

when the weft is inserted pneumatically: the presence of fluff is the cause of difficulties, and it may even not be possible to transfer the weft.

For cleaning to eliminates the fluff, installations exist for blowing air which operate permanently and are common to a set of looms, with a sliding carriage. These installations are troublesome and difficult for the operator; the frequency at which they pass each point or area to be cleaned remains inadequate and their power consumption is high.

OBJECT OF THE INVENTION

It is the object of the invention to provide an improved cleaning device for a loom which obviates these problems.

SUMMARY OF THE INVENTION

The present invention remedies these drawbacks by providing a cleaning device operating by blowing air or by suction, operating not permanently, but sequentially, this device belonging to each loom and being able to operate at any desired frequency and in particular at the production rhythm of the loom.

To this end, the cleaning device according to the invention comprises, upstream of a pneumatic utilization circuit leading to various points to be cleaned on the loom, a pneumatic control circuit connected to a compressed air inlet and comprising, on a main line, a first distributor which is normally closed and the opening of which is controlled at successive instants during the operation of the loom and a second distributor which is normally open, controlled pneumatically, supplied by a branch line of the main line and in which pneumatic delay means are incorporated.

By virture of this pneumatic control circuit, cleaning is brought about sequentially, each cleaning period beginning at an instant when the opening of the first distributor is controlled and terminating at the instant, determined by the pneumatic delay means, when the second distributor is closed.

Preferably, the first distributor, which is normally closed, is controlled mechanically in a cyclic manner by a rotary member of the loom, forming a cam. Thus, in particular the opening of the first distributor may be controlled by the shaft of the delivery roller for the fabric of the loom, provided with at least one boss or lug cooperating with a roller connected to the slide of the first distributor. The cleaning device thus operates at the production rhythm of the loom.

In order to implement the pneumatic delay function, there are advantageously incorporated in the branch line for supplying the second distributor, which is normally open, a non-return valve with adjustable restriction throttle and a pneumatic chamber. The arrangement composed of the second distributor, of the non-return valve with adjustable restriction and of the chamber, may be constituted by a commercially available one-piece pneumatic delay system, thus providing an economic and compact construction. The operation of this delay system is as follows: in conjunction with all the circuits:

when the first distributor is controlled mechanically, compressed air arrives not only in the utilization circuit through the main line and the second distributor which is initially open, but also fills the chamber passing through the restriction of the branch line.

After a period of time which can be modified by the adjustable restriction, the supply pressure of the second distributor is reached; the state of the latter is changed, which cuts the supply to the utilization circuit.

When the first distributor is no longer controlled and recloses, the chamber empties rapidly through the non-return valve and the second distributor also returns to its initial state, allowing the beginning of a new identical sequence next time the first distributor is controlled.

One thus obtains a sequential operation of the cleaning device, carried out with a frequency linked directly to the production of the loom and thus to the actual cleaning needs, the frequency and duration of the air-blowing sequences nevertheless being able to be adapted to each particular application, on account of the adjustable delay and the possibility of multiplying the bosses on the rotary member which controls the initiation of each air-blowing sequence through the intermediary of the first distributor. The choice of a sequential operation also creates a cleaning effect by "pulses", which has proven to be more effective than cleaning by permanent jets while also consuming much less compressed air and thus less power. Finally, since the device is provided on each loom, it does not require any special expensive or troublesome installation, the only requirement being of providing a source of compressed air on the loom and it allows very localised cleaning, by blowing nozzles, distribution ramps or suction means located on the loom very close to the points or areas to be cleaned.

BRIEF DESCRIPTION OF THE DRAWING

The invention will be better understood from a reading of the following description, referring to the sole FIGURE of the accompanying diagrammatic drawings which is a diagram of one embodiment of this sequential cleaning device for a loom.

SPECIFIC DESCRIPTION

In this drawing, the pneumatic control circuit designated generally by the reference numeral 1 is located between a compressed air inlet 2 and a pneumatic utilization circuit which may comprise several branches 3,4,5 leading for example to a distribution ramp 6, a suction member 7 and other blowing means, such as nozzles, provided at various points or areas of the loom for cleaning fluff for example therefrom.

The device 1 comprises, on a main line 8, a first distributor 9 of the 3/2 type which is normally closed, controlled mechanically and returned by spring means and, downstream of this first distributor 9, a second distributor 10 of the 3/2 type which is normally open, controlled pneumatically and returned by spring means.

Starting from a point 11 situated on the main line between the two distributors 9,10 is a branch line 12, in which a non-return valve (one-way or check valve) 13 with adjustable restriction 14 in parallel therewith and a pneumatic chamber 15 are incorporated. The branch line 12 applies the pressure in chamber 15 to the second distributor 10.

The functional arrangement 16 composed of this second distributor 10, of the non-return valve 13 with adjustable restriction 14 and of the chamber 15, forming a pneumatic delay system, may be a commercially available one-piece delay system of the "FESTO" type VZO-3-PK-3.

For the mechanical control of the first distributor 9, one or more bosses or lugs 18 is provided on the shaft 17 of the delivery roller for the woven fabric of the loom, the latter forming a type of cam which co-operates with a roller 19 connected to the slide of the distributor 9. One thus achieves a mechanical control, the initiation of which is directly linked with the production of the loom.

When the roller 19 is not engaged by a boss 18, the first distributor 9 remains closed and it thus closes off the compressed air inlet 2. The utilization circuit 3,4,5 is thus not supplied with compressed air.

When the roller 19 is moved by passing over a boss 18, it actuates the first distributor 9 in order to open it. The compressed air thus passes freely through the main line 8, the second distributor 10 being open and this air passes through the circuit lines 3,4,5 to the various points or areas of the loom to be cleaned.

At the same time, the compressed air fills the chamber 15 through the intermediary of the restriction 14. Once the pressure threshold of the second distributor 10 has been reached, the latter is actuated in order to close it. The outlet of the utilization circuit 3,4,5, leading to the various points or areas to be cleaned, is thus closed off.

When the roller 19 has passed the boss 18 and is released, which restores the first distributor 9 to its initial closed state, the chamber 15 empties rapidly through the non-return valve 13 and the second distributor 10 returns to its initial open state. The entire control circuit 1 is thus in the starting position and is ready to operate in the same manner, next time the roller 19 passes over the same boss or another boss 18, depending on the number of bosses on the shaft 17.

If, subsequent to a stoppage of the loom, the roller 19 remains actuated by a boss 18 after the delay period determined by the pneumatic delay system 16, the purge of the circuit described previously does not take place and the outlet of the utilization circuit 3,4,5 remains closed off by the second distributor 10.

The sequential cleaning device described previously can be applied to looms in general, whether having pneumatic insertion of the weft or mechanical insertion of the weft, but in this case having a source of compressed air available.

Naturally, the invention is not limited to the single embodiment of this sequential cleaning device for a loom which was described above, by way of example. On the contrary, it includes all variations of construction and application based on the same principle. Thus, in particular, it would not be outside the scope of the invention to provide other mechanical control means or control means of a different type for the first distributor, or to connect the pneumatic control circuit to a utilization circuit constructed in another manner.

What is claimed is:

1. A sequential cleaning device operable by compressed air for a loom, the device comprising, upstream of a pneumatic utilization circuit leading to various points to be cleaned on the loom, a pneumatic control circuit connected to a compressed air inlet and comprising, on a main pneumatic line, a first distributor which is normally closed and whereof the opening is controlled at successive instants at the time of operation of the loom and a second distributor which is normally open, controlled pneumatically and supplied by a branch pneumatic line of the main pneumatic line and associated with which are pneumatic delay means, the first distributor being controlled mechanically and cyclically by a rotary member of the loom.

2. A sequential cleaning device according to claim 1, in which the rotary member is a cam.

3. A sequential cleaning device according to claim 2, in which the first distributor is controlled by a shaft of a delivery roller for the fabric of the loom which shaft is provided with at least one boss or lug co-operating with a roller connected to a slide of the first distributor.

4. A sequential cleaning device according to claim 1, in which a non-return valve with adjustable restriction and a pneumatic chamber are incorporated in the branch line for supplying the second distributor.

5. A sequential cleaning device for a loom according to claim 4, in which the second distributor, the non-return valve with adjustable restriction and the chamber are all constituted by a one-piece pneumatic delay system.

* * * * *